United States Patent [19]

Coldren et al.

[11] Patent Number: 4,577,920

[45] Date of Patent: Mar. 25, 1986

[54] ELECTRICAL ASSEMBLY WITH CABLE GUIDING MEMBER

[75] Inventors: Daniel R. Coldren, Enola; James Pritulsky, Harrisburg, both of Pa.

[73] Assignee: AMP Incorporated, Harrisburg, Pa.

[21] Appl. No.: 660,626

[22] Filed: Oct. 15, 1984

[51] Int. Cl.[4] ..... H01R 13/46

[52] U.S. Cl. ..... 339/143 R

[58] Field of Search ..... 339/14 R, 143 R

[56] References Cited

U.S. PATENT DOCUMENTS

| | | | |
|---|---|---|---|
| 4,352,531 | 10/1982 | Gutter | 339/14 R |
| 4,386,814 | 6/1983 | Asick | 339/143 R |
| 4,457,575 | 7/1984 | Davis et al. | 339/176 MP |
| 4,493,525 | 1/1985 | Hall et al. | 339/143 R |

FOREIGN PATENT DOCUMENTS

| | | | |
|---|---|---|---|
| 0094173 | 11/1983 | European Pat. Off. | 339/14 R |

*Primary Examiner*—Gil Weidenfeld

*Assistant Examiner*—Gary F. Paumen

*Attorney, Agent, or Firm*—Robert W. J. Usher

[57] ABSTRACT

A one-piece metal cable guide member for guiding an undersize cable into a shielded plug housing which has a cable supporting base (18), cable locators (24, 25) upstanding from the base (18) in spaced apart relation to locate between them an insulated conductor row (42) and cable sheath (41) and shielding flanges (26) upstanding from the base (18) to extend along a rear end between opposite side edges of the base (18) and the cable locators (24, 25). The cable guide member is inserted front end leading into the mouth (31) of the plug cavity guiding the conductors (41) into pathways communicating with the mouth with the shielding flanges (26) completely closing and thereby shielding the mouth (31) on each side of the cable. The cable shield (43) is pressed against the base (18) which connects directly with flaps (36) extending into the mouth from the housing shield (35).

13 Claims, 5 Drawing Figures

ELECTRICAL ASSEMBLY WITH CABLE GUIDING MEMBER

The invention relates to electrical plug assemblies and particularly to a cable guiding member for shielded electrical plug assemblies.

There is widespread use of modular plugs and receptacles, in particular in the telecommunication and data industries, in which a series of closely spaced conductors terminated in the plugs are connected to a series of contacts in the receptacles. The receptacles are normally fixed to an installation such as a printed circuit board and in anticipation of an expansion of the data transmission facility it is desirable initially to provide an oversize receptacle with provision for more lines than initially required. However, to avoid possibilities of mismating it is also desirable to utilize a complementary plug, similarly oversized and, in practice, the industry has sought keying arrangements which prevent mating of plugs and receptacles of different sizes. For this reason, there is a requirement to assemble and terminate conductors of shielded cable in an oversize plug.

Problems, however, arise both in feeding the conductors accurately into alignment with the predetermined plug contacts for termination and maintaining the integrity of the shielding of at the rear end of the resulting assembly inspite of the undersized cable.

According to the invention, there is provided a cable guide member which both guides undersize cable accurately into a plug assembly housing and ensures that the rear of the housing is completely shielded after assembly inspite of the undersize cable.

More specifically, the cable guide member is stamped and formed from a single piece of sheet metal and has front and rear ends between which extends a cable supporting base, cable locators upstanding from the base in spaced apart relation to located between them a row of insulated conductors and a sheath of a cable extending between front and rear ends of the guide member and shielding flanges bent up from the base to extend across the rear end between opposite side edges of the base and the cable locators.

The cable guide member may be provided with means upstanding from the general plane of the base to engage the leading end of the cable sheath to limit forward movement of the cable when loaded onto the base.

In a preferred construction, the base is stepped up towards the front end to provide a platform supporting the row of insulated conductors centrally of the cable, the step providing the limiting means. This locates the row of insulated wires centrally of the cable and housing while the step also facilitates handling.

Desirably, the cable locators comprise a first pair of flanges upstanding from the platform for receiving the insulated conductor array between them and a second pair of flanges upstanding from the base adjacent the rear for receiving the cable sheath between them. The sheath locators comprise a pair of resilient, sheath clamping arms extending forwardly cantilever fashion from root ends integral with the shield flanges.

The cable guide member can be economically manufactured using conventional stamping and forming techniques.

An example of the invention will now be described with reference to the accompanying drawings in which.

Figure 1:
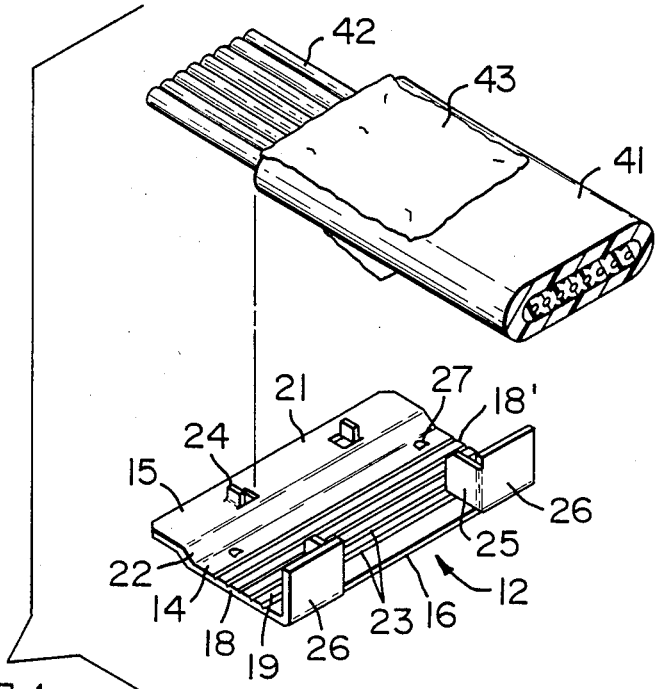
FIG. 1 is an exploded isometric view of a cable guide member according to the invention with a leading end portion of flat cable prepared for termination.
Figure 2:
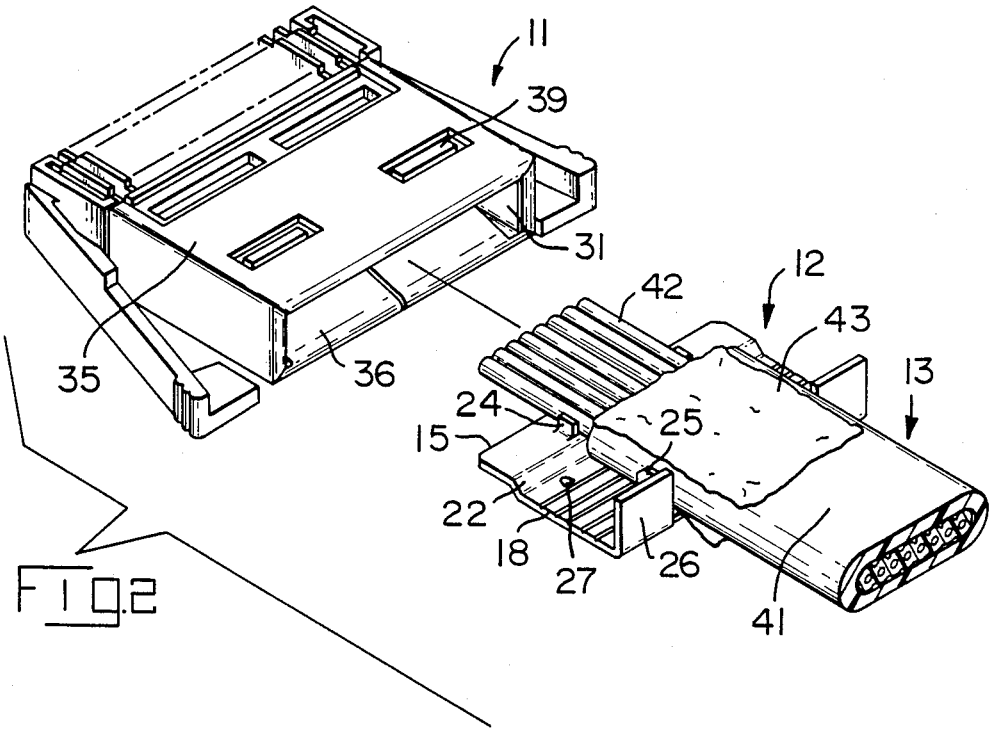
FIG. 2 is an isometric view of cable loaded into the guide member and aligned for insertion into a shielded modular plug.
Figure 3:
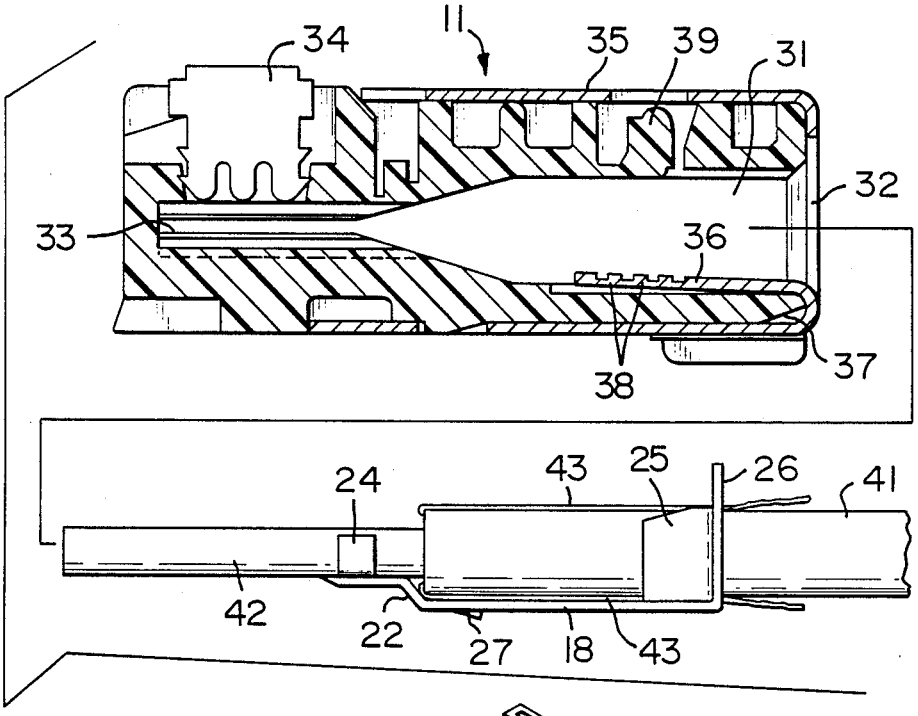
FIG. 3 is a cross-sectional view of the shielded modular plug with the cable and guide member in elevation.
Figure 4:
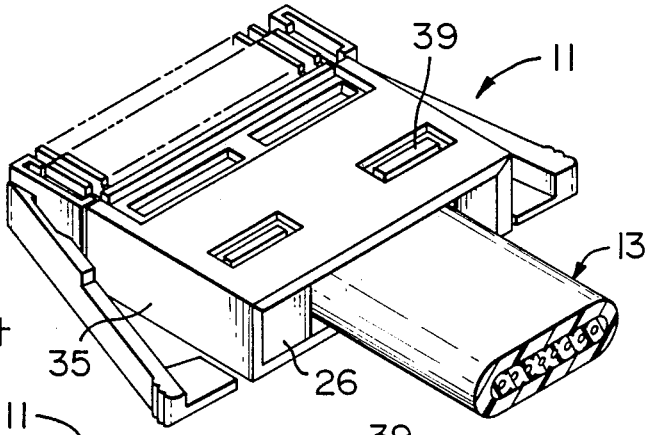
FIG. 4 is an isometric view of an electrical assembly of the invention in which the cable loaded into the guide member is terminated in the shielded modular plug.

The electrical plug assembly comprises a shielded modular plug 11 similar to that described in our U.S. Pat. No. 4,457,575 (disclosure of which is incorporated herein by reference), a cable guide member 12 and a flat cable 13.

The cable guide member 12 is stamped and formed in one-piece from sheet metal and comprises a cable supporting base 14 having front and rear ends 15 and 16, respectively, and opposite side edges 18 and 18'. The base is stepped up towards the front end to provide a lower, cable supporting surface 19 and a raised, insulated conductor row supporting platform 21, the step 22 providing a cable stop as explained below. The cable supporting surface 19 is formed with a series of transversely extending serrations 23. Cable locators comprise a first pair of flanges 24 struck out to upstand from the platform 21 in spaced, opposed relation and a second pair of flanges 25 extending forwardly, cantilever fashion, in spaced, opposed relation at the rear end of the base from inner opposed ends of shield flanges 26 bent up from the rear end of the base and extending to the side edges 18. Locking protuberances 27 are struck out of the base to extend out of the underside of the base.

The plug housing 11 is moulded from suitable plastics material with a cable receiving mouth 31 opening to a housing rear 32 and communicating internally with a series of passageways 33 extending to a front of the housing for receiving respective individual insulated conductors of the cable and guiding them into alignment with respective terminals 34 of a series of terminals preloaded in the housing.

A stamped and formed metal shield 35 is secured around the housing to extend forwardly from a rear end where it completely surrounds the mouth 22. The shield is integrally formed with resilient flaps 36 returned around the lip 37 to extend into the mount forwardly in cantilever fashion. Upper surfaces of the flaps 36 are formed with serrations 38.

Prior to assembly, the outer insulating sheath 41 of the flat cable 13 is cut away from the end to be terminated to expose a row 42 of insulated conductors and the foil shield 43 is reversely bent to extend along the sheath. The prepared end of the cable is then loaded onto the guide with the exposed insulated conductor 42 located between first locators 24 and the sheath clamped between second locators 25.

The subassembly thus formed is inserted into the mouth of the housing, drawer fashion, with flexure of the flaps 36 until the locking protuberances engage the free ends of the flaps in a snap action. The insulated conductors are thereby easily guided into respective passageways.

Figure 5:
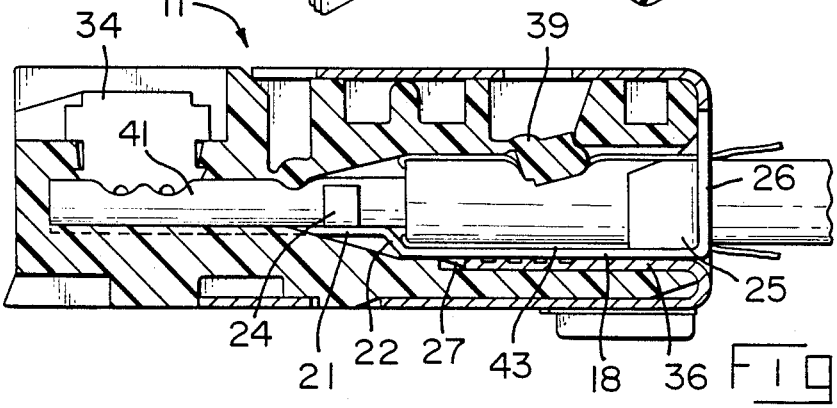
FIG. 5 is a cross-sectional view of the terminated assembly according to the invention.

The terminals are then driven into the wires and the strain relief clamps 39 depressed against the cable ensuring a good electrical contact between the cable foil shield 43, the base 18 of the cable guide and the flaps 36, as shown in FIG. 5. The shielding flanges 26 of the cable guide completely close the mouth thereby to shield the rear end of the assembly which would otherwise only be partly shielded as a result of the cable being undersize.

We claim:

1. An electrical plug assembly comprising an insulated housing having a cable-receiving mouth opening to a rear end of the housing and communicating internally of the housing with a row of conductor-receiving pathways extending to a front end of the housing in alignment with respective terminals, a shield member of conductive material extending around the housing forwardly from the rear end to provide a substantially continuous shield around the mouth;

a one-piece cable guide member of conductive material having front and rear ends between which extends a cable supporting base, cable locators upstanding from the base in spaced apart relation to locate between them an insulated conductor row and cable sheath extending between front and rear ends of the cable guide member and, shielding flanges upstanding from the base to extend along the rear end between opposite side edges of the base and the cable locators;

whereby on loading a shielded cable into the guide member with an outer insulation sheath stripped cut back from a front end to expose the row of insulated conductors free of the shield with the cable located between the cable locators, the cable guide member can be inserted, front end leading, into the mouth, drawer fashion, as a sliding fit, guiding the conductors into respective ones of said pathways with the shield flanges completely closing the mouth on each side of the cable and electrically connected to the shield.

2. An electrical plug assembly according to claim 1 in which the cable guide member is stamped and formed from sheet metal.

3. An electrical plug assembly according to claim 1 in which the cable guide member is provided with means upstanding from the general plane of the base to engage the leading end of the cable sheath to limit forward movement of the cable when loaded onto the base.

4. An electrical plug assembly according to claim 3 in which the base is stepped up towards the front end to provide a platform supporting the insulated conductor array centrally of the cable, the step providing the limiting means.

5. An electrical plug assembly according to claim 4 in which the cable locators comprise a first pair of flanges upstanding from the platform for receiving the insulated conductor array between them and a second pair of flanges upstanding from the base adjacent the rear for receiving the cable sheath between them.

6. An electrical plug assembly according to claim 5 in which the sheath locators comprise a pair of resilient sheath clamping arms extending forwardly cantilever fashion from root ends integral with the shield flanges.

7. An electrical plug assembly according to claim 1 in which the shield member includes resilient flaps extend forwardly into the mouth cantilever fashion across a floor of the housing and are engageable with the base of the cable guide member when the cable guide member is inserted into the housing to effect the electrical connection to the flanges through the base.

8. An electrical plug assembly according to claim 7 in which a locking protuberance extends downwardly from the base of the cable guide member for engagement with forward free ends of the flaps to lock the shield member in the housing.

9. An electrical plug assembly according to claim 7 in which a strain relief member is depressable into the mouth into engagement with the cable sheath with the cable shield sandwiched between the base of the cable guide member and the flaps thereby to press the cable shield, the cable guide member and the flaps against each other.

10. A cable guide member for an electrical plug assembly according to claim 1 which cable guide member is stamped and formed from a single piece of sheet metal and has front and rear ends between which extends a cable supporting base, cable locators upstanding from the base in spaced apart relation to located between them an insulated conductor row and sheath of a cable extending between front and rear ends of the cable guide member and, shielding flanges upstanding from the base to extend along the rear end between opposite side edges of the base and the cable locators.

11. A cable guide member according to claim 10 in which the base is stepped up towards the front end to provide a platform supporting the insulated conductor array centrally of the cable, the step providing the limiting means.

12. A cable guide member according to claim 11 in which the cable locators comprise a first pair of flanges upstanding from the platform for receiving the insulated conductor array between them and second pair of flanges upstanding from the base adjacent the rear for receiving the cable sheath between them.

13. A cable guide member according to claim 11 in which the sheath locators comprise a pair of resilient sheath clamping arms extending forwardly cantilever fashion from root ends integral with the shield flanges.

* * * * *